United States Patent [19]

Potter, Jr.

[11] Patent Number: 4,895,095

[45] Date of Patent: Jan. 23, 1990

[54] OUTBOARD MOTOR MOUNTING DEVICE

[76] Inventor: William S. Potter, Jr., 4235 Douglas Rd., Coconut Grove, Fla. 33133

[21] Appl. No.: 95,349

[22] Filed: Sep. 10, 1987

Related U.S. Application Data

[63] Continuation of Ser. No. 764,543, Aug. 12, 1985, Pat. No. 4,708,087.

[51] Int. Cl.[4] ..... B63B 5/12

[52] U.S. Cl. ..... 114/343; 114/357; 440/900; 248/640

[58] Field of Search ..... 114/56, 357, 364, 362, 114/343, 352; 248/640-643; 440/900

[56] References Cited

U.S. PATENT DOCUMENTS

| | | | |
|---|---|---|---|
| 1,861,048 | 5/1932 | Conover | 248/641 |
| 2,764,119 | 9/1956 | Sigler | 248/641 |
| 2,842,086 | 7/1958 | Yost | 248/641 |
| 2,886,462 | 5/1959 | Jagiel | 248/641 |
| 4,708,087 | 11/1987 | Potter, Jr. | 114/362 |

*Primary Examiner*—Joseph F. Peters, Jr.
*Assistant Examiner*—Ed Swinehart
*Attorney, Agent, or Firm*—Webb, Burden Ziesenheim & Webb

[57] ABSTRACT

The outboard motor mounting device comprises a body having a hollow interior to provide buoyancy to the mounting device. The body has a bottom wall, opposed side walls, a front wall, a rear wall and an upwardly facing concave formation. A first flange is connected to the front wall and extends upwardly from the body. A second flange extends upwardly from the rear wall. The upwardly facing concave formation is configured and dimensioned so that a portion of the outboard motor can be moved into the concave formation when the propeller of the motor is raised out of the water.

12 Claims, 3 Drawing Sheets

OUTBOARD MOTOR MOUNTING DEVICE

This is a continuation of co-pending application Ser. No. 764,543, filed on Aug. 12, 1985, now U.S. Pat. No. 4,708,087.

BACKGROUND OF THE INVENTION

1. Field of the Invention

The present invention is directed to a device mounted to the transom of a boat for mounting one or more outboard motors or engines and more particularly to a device which additionally provides reinforcement to the transom, which allows full engine tilt without hitting the transom and which adds buoyancy to the combined structure of the boat and device particularly when the motor(s) or engine(s) is tilted out of the water.

2. Description of the Prior Art

Heretofore various devices have been proposed for mounting an outboard motor or engine to the transom of a boat.

One such device comprises a one piece welded steel framework which, of course, adds weight to the boat and which does not necessarily provide for full engine tilt out of the water without hitting the transom.

Another device is a pulpit shaped fiberglass structure which has side walls, a rear wall and a bottom wall which define a forwardly facing opening. The outwardly flanged edges of the structure around the opening are adapted to be secured to the transom of the boat. This pulpit shaped outboard motor mounting device suffers from the danger of adding weight to the boat when the well within the pulpit fills with water.

As will be described in greater detail hereinafter, the outboard mounting device of the present invention differs from the previously proposed mounting devices by providing an outboard motor mounting device which includes a body having a sealed hollow interior cavity or compartment for providing buoyancy to the device which mounts to the transom by means of its fully mating forward wall and which has an upper or upwardly facing concave formation into which an outboard motor or engine can be fully tilted when raising the propeller of the motor or engine out of the water.

SUMMARY OF THE INVENTION

According to the invention there is provided an outboard motor mounting device comprising a body having a hollow interior to provide buoyancy to said mounting device, a bottom wall, opposed side walls, a front wall, a first flange which is connected to said front wall and which extends upwardly from said device, mounting means for mounting said body to the transom of a boat, a rear wall with an upwardly extending second flange for receiving and mounting an outboard motor and an upwardly facing concave formation into which a portion of the outboard motor can be moved when raising the propeller of the motor out of the water.

DESCRIPTION OF THE PREFERRED EMBODIMENTS

Figure 1:
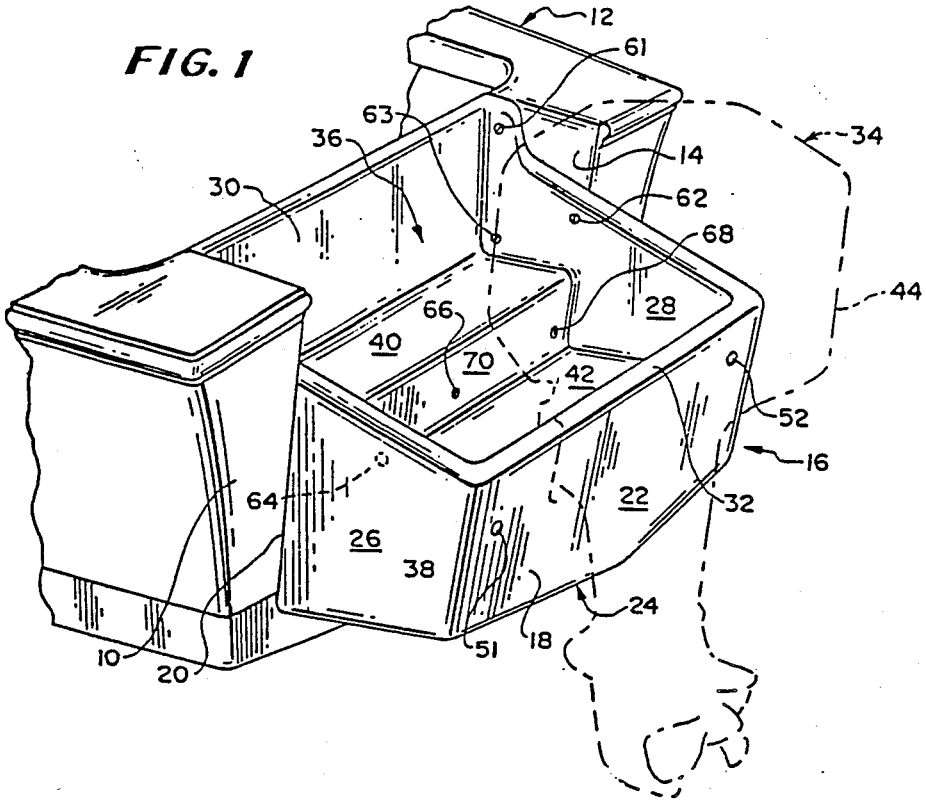
FIG. 1 is a fragmentary perspective view of the transom of a boat which has a recessed area and shows an outboard motor mounting device constructed according to the teachings of the present invention mounted in the recessed area in the transom.
Figure 2:
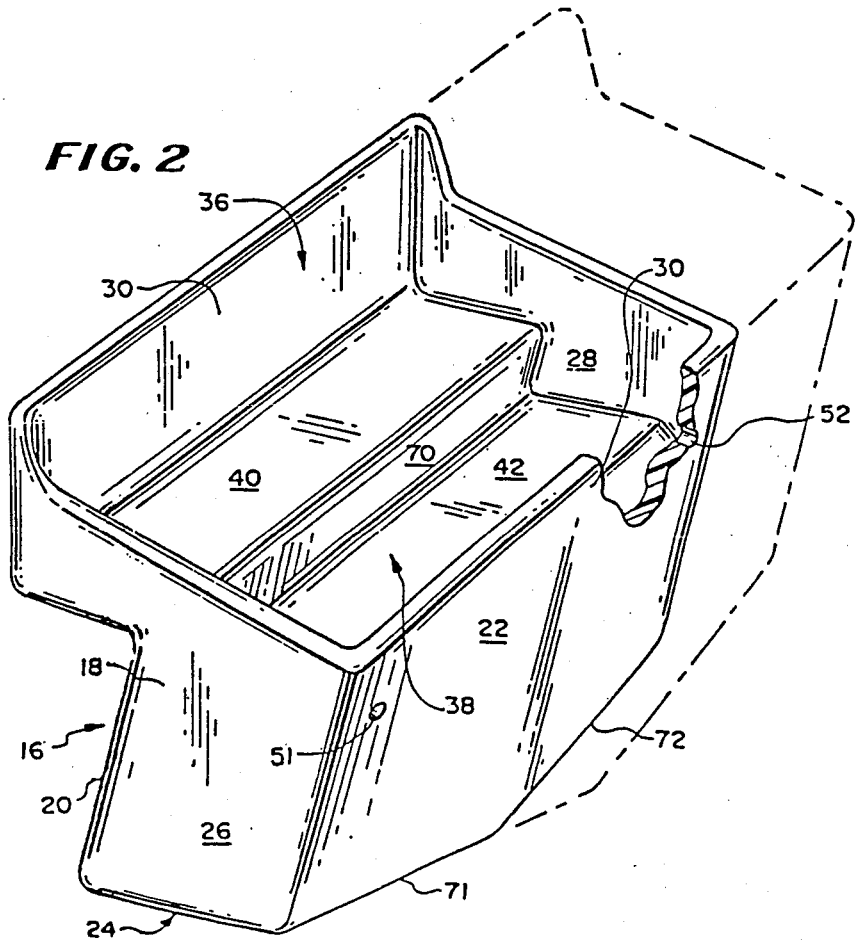
FIG. 2 is a top perspective view of the transom shown in FIG. 1 and shows in phantom a larger size of the outboard motor mounting device.
Figure 3:
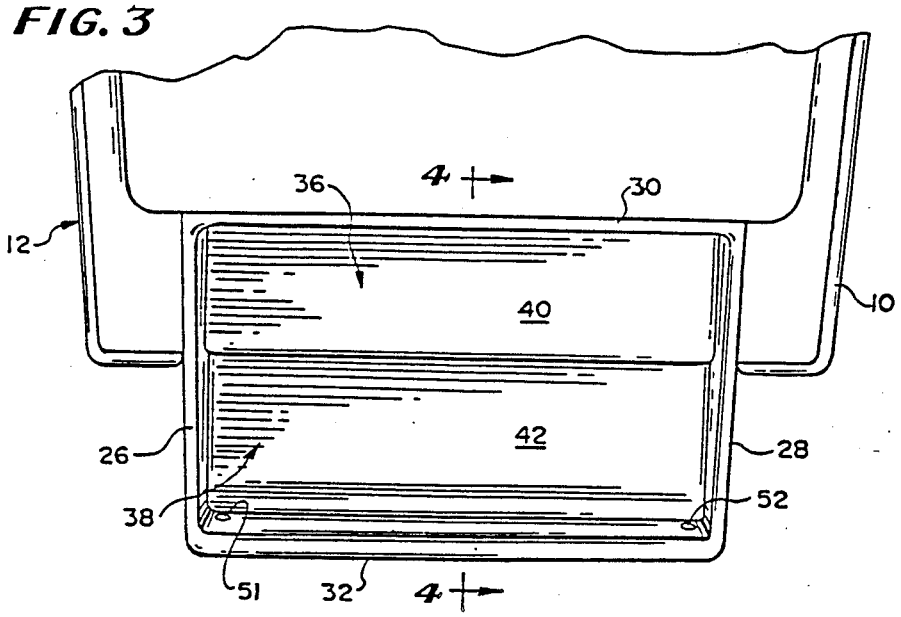
FIG. 3 is a top fragmentary plan view of the transom of the boat shown in FIG. 1 and of the outboard motor mounting device.

Referring now to the drawings in greater detail, there is illustrated in FIG. 1 a transom 10 of a boat 12. The transom 10 has a recessed area 14 or cutout in which an outboard motor mounting device 16 constructed according to the teachings of the present invention is received and fixed to the transom 10. The device 16 includes a body 18 made of reinforced plastic or any other structurally adequate material and having a front wall 20, a rear wall 22, a bottom wall 24 and opposed side walls 26 and 28. A first flange 30 is connected to the front wall 20 and, in the embodiment of the device 16 shown in FIGS. 1–3, is positioned forward of the forward wall 20.

The rear wall 22 has an upwardly extending second flange 32 which is adapted to receive and mount an outboard motor 34 shown in phantom in FIG. 1.

Further, the device 16 has an upwardly facing concave formation 36 defined between the opposed side walls 26 and 28, the first flange 30 connected to the front wall 20 and the second flange 32 extending upwardly the rear wall 22. The upper concave formation 36 is defined by a stepped cavity 38 which includes a forward upper step 40 and a rear lower or bottom floor 42. The forward step 40 is over a lower ledge or recessed step formation (not shown) of the recessed area 14.

According to the teachings of the present invention, the stepped cavity 38 is dimensioned to provide sufficient space for receiving an upper portion 44 of the outboard motor 34 when the outboard motor 34 is tilted about its mount to the second flange 32 in order to raise propeller 46 of the motor 34.

Further, as shown, the second flange 32 has at least two drain holes 51 and 52 which are positioned just above the bottom floor 42 so that any water or other liquid that gets into the cavity 38 is drained from the cavity 38.

Further, mounting holes 61–63 are provided in each side wall 26 and 28 for receiving fasteners for supplemental securing of the device 16 to the inner liner of the boat's hull (not shown). Other mounting holes 66 and 68 can be provided in a vertical wall 70 of the step 40.

As shown, the bottom wall 24 can be formed with a downwardly facing V shape such that a first inclined bottom wall portion 71 extends downwardly toward the keel line of the device 16 and a second inclined bottom wall portion 72 inclining downwardly toward the keel line of the device but with both wall portions 71 and 72 located above the bottom surface or hull 73.

A significant performance advantage is gained when the thrust point of the propeller 46 is positioned further behind the boat 12. An improvement of speed or efficiency of a boat/engine combination of up to 10% is gained. This advantage is gained by providing a bottom surface to the device 16 which is "stepped" significantly above that of the boat 12. If the bottom surface or "lines" of the device 16 merely extended the planing surface aft in the same proportion as the propeller 46 is moved aft, the fulcrum point would be in essentially the same relationship to the thrust of the propeller 46 as that produced when the motor 34 is directly mounted to the transom 10 of the boat 12. However, with the device 16 of the present invention, additional leverage to the propeller 46 is provided. This leverage allows the bow of the boat 12 to be raised higher by the greater downward thrust movement of the propeller 46 of a motor 34 mounted on the device 16. The raising of the bow of the boat 12 increases speed, and thus efficiency, by reducing the wetted length of the planing surface of the boat's hull 73.

Figure 4:
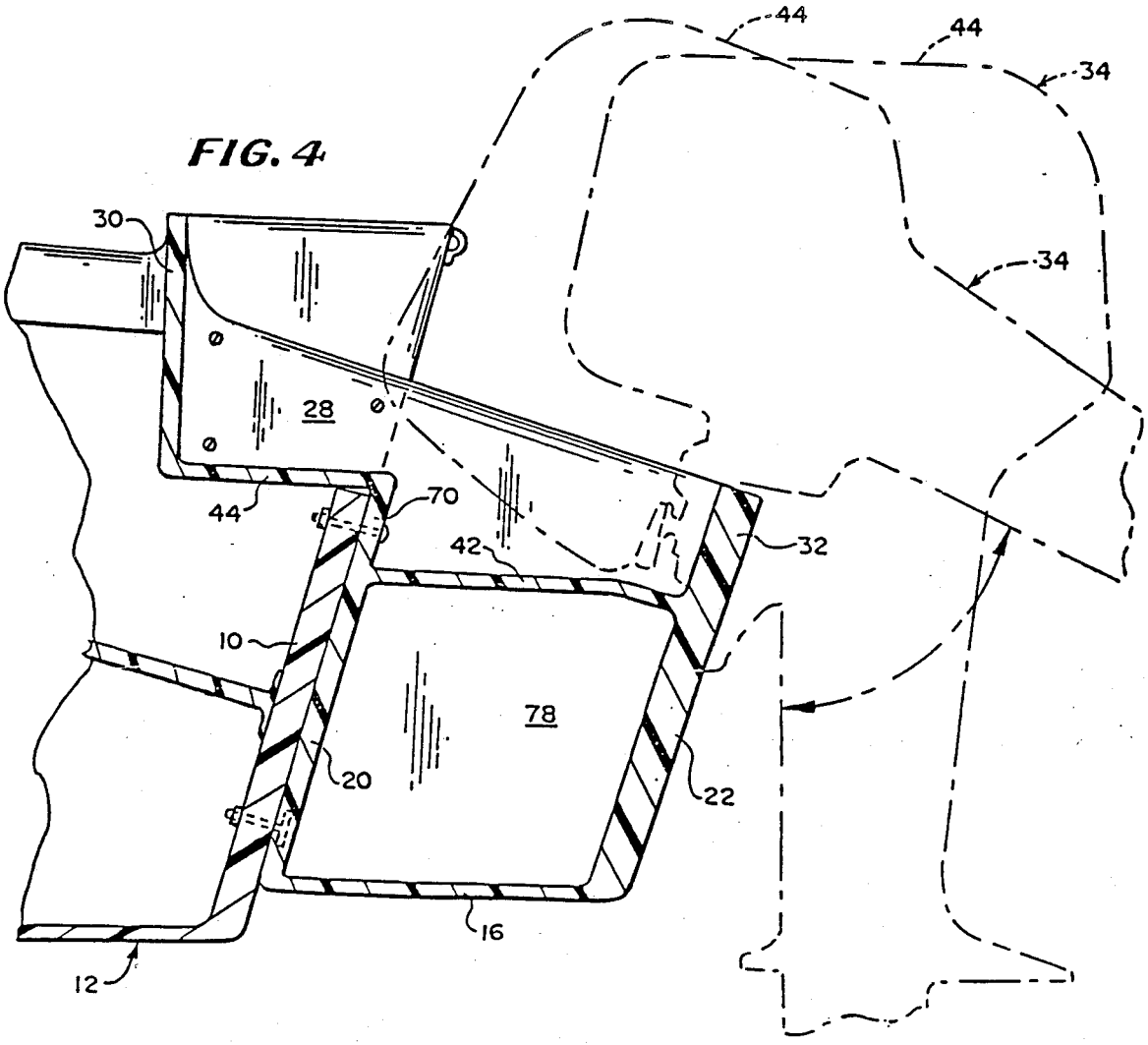
FIG. 4 is a vertical, sectional view of the outboard motor mounting device and is taken along line 4—4 of FIG. 3.

As best shown in FIG. 4, a hollow cavity or compartment 38 is formed between the bottom wall 24, the deeper floor portion 42, the front wall 20, the rear wall 22, and the opposed side walls 26 and 28. This hollow cavity 38 provides buoyancy to the outboard motor mounting device 16, such buoyancy providing a number of advantages over prior outboard motor mounting devices.

Furthermore, the cavity 38 can be used for storing equipment, can be used as a live bait box, or, can be divided into compartments, some of which are used and some of which are closed off.

Figure 5:
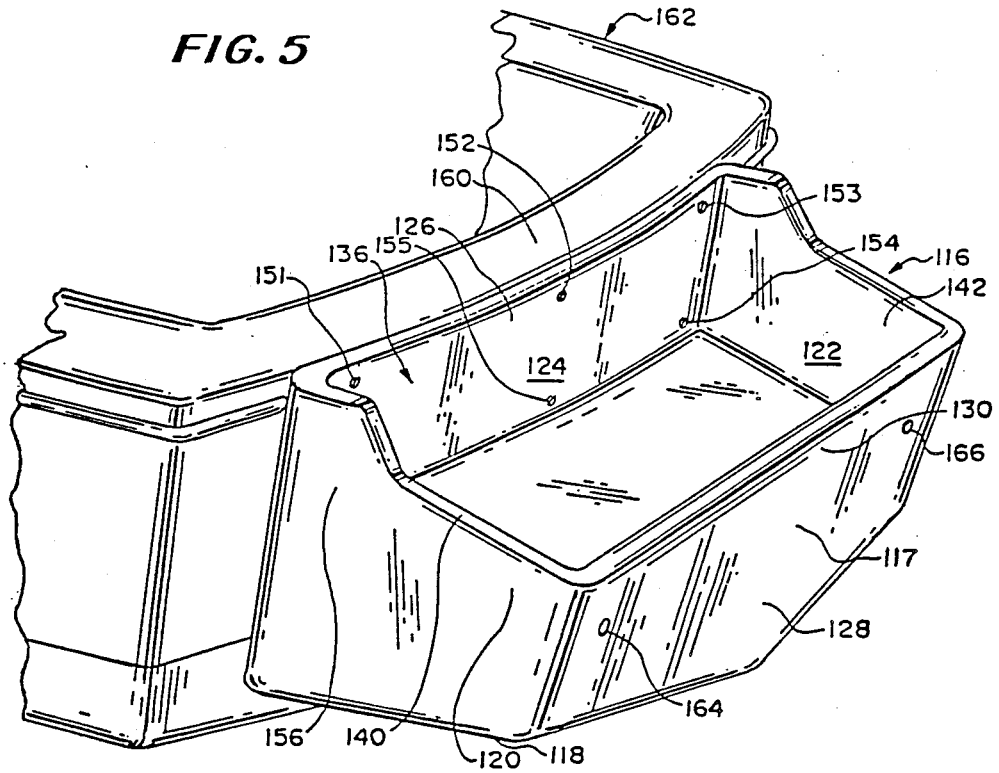
FIG. 5 is a perspective view of another transom of another boat with another embodiment of the outboard motor mounting device constructed according to the teachings of the present invention fixed thereto.

Referring now to FIG. 5, there is illustrated therein another embodiment of the outboard motor mounting device of the present invention which is generally identified by reference numeral 116. This outboard motor mounting device 116 includes a body 117 which has an inclined bottom wall 118, opposed side walls 120, 122, a curved front wall 124 with an upwardly extending first flange 126 which is also curved and coextensive with the front wall 124, and a rear wall 128 having a second upwardly extending flange 130 adapted to mount an outboard motor. Further, the device 116 has an upwardly facing concave formation 134 including a cavity 136 defined between the first flange 126 and the second flange 130 and upwardly extending wall portions 140 and 142 of the opposed side walls 120 and 122. Here there is no stepped configuration in the cavity 136 but rather the depth of the cavity 136 is further defined by a floor, or top wall 144 of the body 117.

Mounting means in the form of mounting holes 151, 152, 153, 154, 155, and 156 are provided in the first flange 126 for receiving bolts or screws for fastening the front wall 124 to the transom 160 of a boat 162. Also, at least two drain holes 164 and 166 are provided in the second flange 130.

Figure 6:
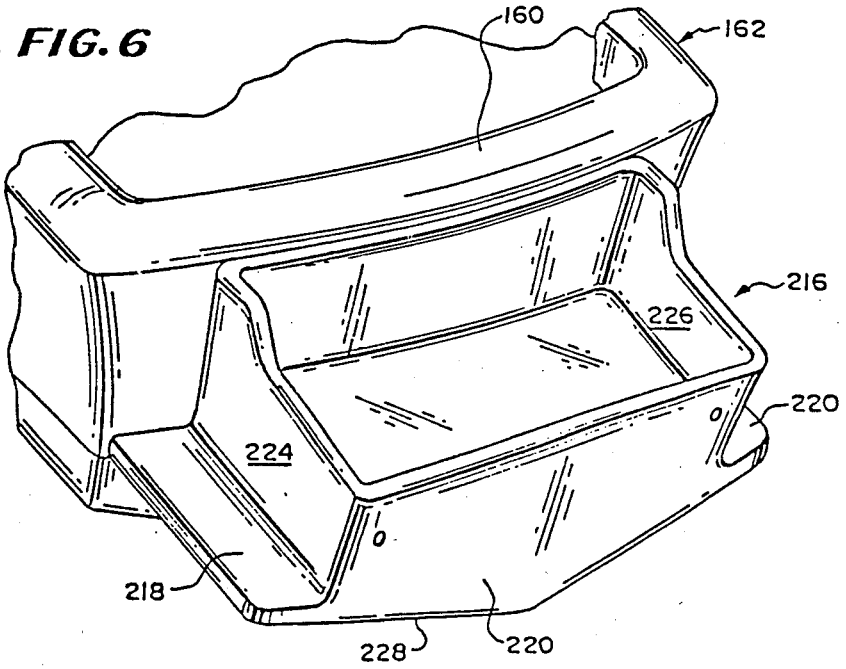
FIG. 6 is a top perspective view of another embodiment of an outboard motor mounting device constructed according to the teachings of the present invention secured to the transom of the boat shown in FIG. 5.

A modified outboard motor mounting device 216 is shown in FIG. 6. Here, the configuration of the outboard motor mounting device 216 is substantially the same as that of the outboard motor mounting device 116 as shown in FIG. 5 except that step-forming flanges 218 and 220 are molded integral with the body 222 of the outboard motor mounting device 216 and extend laterally outwardly from opposed side walls 224 and 226 at and in alignment with the edges of V-shaped bottom wall 228. Such step-forming flanges 218 and 220 are useful when entering the water from the boat or returning to the boat from the water.

It will be understood that both of the outboard motor mounting devices 116 and 216 have a hollow compartment or cavity therein in the body 117 or 222 to provide additional buoyancy to the devices 116 and 216 and are made of reinforced plastic or any other structurally suitable material.

The outboard motor mounting devices 16, 116 and 216 of the present invention provide full outboard motor tilt clearance for all current outboard motors or engines without danger of a portion of the engine striking the transom of a boat before reaching its full tilt position. The outboard motor mounting devices 16, 116 and 216 can even accommodate new V-8 outboard motors with their greater full tilt requirements, 32 inches versus 26 inches for most V-6 outboard motors, and 30 inches for in-line 6 cylinder engines.

Further, the outboard motor mounting devices 16, 116 and 216 provide much greater safety in the event of a sudden motor or engine "kickup" resulting from the engine striking a submerged object when running at high speed.

The outboard motor mounting devices 16, 116 and 216 positively increase the buoyancy of the transom of a boat.

In the embodiments of the devices 16, 116 and 216 where the hollow interior cavity or compartment, (38 in FIG. 4) is fully sealed, the devices 16, 116 and 216 add up to 250 pounds of buoyancy whereby the buoyancy not only supports the weight of the device, of approximately 150 pounds, but also adds a buoyancy offset to the mounting of an engine(s), or motor(s) thereon.

The fully sealed "self bailing design" (by reason of the drain holes 51, 52 or 164, 166) greatly enhances safety when the boat is running slowly in steep following seas since it provides earlier buoyancy or lift from an overtaking sea. If the sea does flow over the top of the device it causes only minor, quickly self-bailed, weight addition to the stern of the boat.

Furthermore, the outboard motor mounting device 10 is received in a recessed area 14 in the transom 10 and completely seals the transom 10 of the boat 12 to the full height of the boat's maximum freeboard. This provides an additional safety margin by eliminating the incidious flooding of the cockpit floors caused by waves breaking over a low cut outboard transom 10 while drifting in a seaway.

The large mounting surface area on the forwardly facing portion of the first flange 30 or 126, the surface area behind the vertical wall 70 of the step 40 in the device 16 and the outer facing surfaces of the side walls 26 and 28 or 224 and 226 on front wall 20 or 124 distribute mounting stresses between the transom 10 or 160 and the mounting devices 16, 116 and 216 over a large area.

It is strongly recommended that the devices 16, 116 and 216 be mounted to the transom of a boat by means of an adhesive bonding material between the mating surfaces of the devices 16, 116, 216 and the transoms 10 or 160 in addition to the mounting screws or bolts, thus greatly diminishing localized high stress areas.

Furthermore, the mounting of the device 16, 116 or 216 to the transom 10 or 160 strengthens existing transoms by adding a box-beam stiffening and stress distributing structure to the transom.

Also, with the device 16, 116 or 216 mounted to a transom, it is not necessary to completely plug (or to make complete cosmetic patches over) transom holes caused by former engine mounts, outdrive holes, exhaust tube holes, on board engine mounting holes, etc. Preferably, those holes should be structurally plugged but even this is not required since the device 16, 116 or 216 acts as a large outer patch over any holes it covers.

The devices 16, 116 or 216 greatly reduce the danger of engine "drowning" from "overtaking" stern waves caused by a sudden loss of power or the cutting of the throttle abruptly at planing speeds. This is because of the buoyancy of the device. Also, the extra deep vertical design of the bottom wall of each device 16, 116 or 216 with two bottom wall portions inclining downwardly to a keel line just above that of the boat to which it is attached smooths out the overtaking stern waves allowing the boat to settle down without engulfing the engine.

In some embodiments of the devices 16, 116 and 216 sealable compartments in the hollow interior cavity can be used for housing oil tanks, power trim pumps, trim tab pumps, etc., for gear storage, for bait wells or as a small fish keeper container.

In the device 216 shown in FIG. 6 a nonskid surface step or platform is provided on each flange 218 and 220 on which one can stand on or sit on when entering or leaving the water and/or for making repairs or adjustment to the engine.

As shown in FIG. 2, the device 16 can be made wider so as to accommodate twin outboard motors on one unit as well as a single outboard motor.

The devices 16, 116 and 216 are made of a molded reinforced plastic or any other structurally and functionally suitable material and can be formed with a flat planar front wall or with curved or complex mating surfaces on the outer surface of the front wall and first flange for mating with a mirror image surface on a transom or in an outboard motor well.

From the foregoing remarks, it will be apparent that the outboard motor mounting devices 16, 116 and 216 of the present invention have a number of advantages some of which have been described above and others of which are inherent in the invention.

Also, it will be apparent from the foregoing remarks that modifications can be made to the devices 16, 116 or 216 without departing from the teachings of the invention. Accordingly, the scope of the invention is only to be limited as necessitated by the accompanying claims.

I claim:

1. An outboard motor mounting device for mounting on a boat having a transom cutout which is designed to accommodate an outboard motor comprising a body having a sealed hollow interior to provide buoyancy to said mounting device, a bottom wall, opposed side walls, a front wall, a first flange which is connected to said front wall and which extends upwardly from said device, said front wall and said first flange together having dimensions which when mounted on a boat seal an entire transom cutout of said boat substantially to the full height of its maximum freeboard, mounting means for mounting said body to said transom, a rear wall with an upwardly extending second flange for receiving and mounting an outboard motor and an upwardly facing concave formation into which a portion of the outboard motor can be moved when raising the propeller of the motor out of the water.

2. The device of claim 1 wherein said concave formation is stepped in a fore and aft direction to provide an upwardly facing cavity with a forward stepped portion and a rearward deeper portion.

3. The device of claim 1 wherein the bottom wall of said device is spaced above the bottom hull surface of the boat when said device is mounted to the transom of the boat.

4. The device of claim 1 wherein the buoyancy of the device to the weight of the device is a ratio number of approximately 5:3.

5. The device of claim 1 wherein said second flange has at least one drain hole for draining liquid from said upwardly facing concave formation.

6. The device of claim 1 wherein said mounting means for mounting said body to a transom of a boat includes mounting holes in said first flange for receiving bolts or screws for fastening said first flange to the transom of a boat.

7. The device of claim 1 wherein said first flange is coplanar with said front wall.

8. The device of claim 1 wherein said second flange is coplanar with said rear wall and is inclined relative to said bottom wall of said body.

9. The device of claim 1 wherein the depth of said upwardly facing concave configuration and the fore-aft dimension of the upwardly facing concave configuration are sufficient to allow full tilt of an outboard motor mounted to said second flange without the engine or motor striking the transom of the boat.

10. The device of claim 1 wherein said mounting means includes an adhesive bonding material situated between mating surfaces of said device and the transom of said boat.

11. The device of claim 1 wherein said bottom wall has a V configuration.

12. The device of claim 1 being made of reinforced plastic.

* * * * *